United States Patent [19]

Molins et al.

[11] 3,987,804

[45] Oct. 26, 1976

[54] MANUFACTURE OF CIGARETTES AND THE LIKE

[75] Inventors: Desmond Walter Molins, London, England; Francis Auguste Maurice Labbe, Neuilly sur Seine, France

[73] Assignee: Molins Limited, London, England

[22] Filed: Sept. 25, 1972

[21] Appl. No.: 292,200

Related U.S. Application Data

[63] Continuation-in-part of Ser. No. 22,955, March 26, 1970, Pat. No. 3,736,941.

[30] Foreign Application Priority Data

Apr. 2, 1969 United Kingdom ..... 17135/69

[52] U.S. Cl. ..... 131/84 B

[51] Int. Cl.[2] ..... A24C 5/18

[58] Field of Search ..... 198/193; 131/8 R, 9, 131/21 R, 64 R, 21 B, 66 R, 21 D, 146, 84 R, 84 B, 84 C, 108, 109 R, 110, 20 R, 20 A

[56] References Cited

UNITED STATES PATENTS

| | | | |
|---|---|---|---|
| 899,376 | 9/1908 | Bergstraesser | 131/84 R |
| 1,183,618 | 5/1916 | Aiton | 131/109 R |
| 1,829,559 | 10/1931 | Gilliam | 131/8 R |
| 2,570,270 | 10/1951 | Patterson | 131/108 |
| 2,660,178 | 11/1953 | Rault | 131/84 B |
| 2,938,521 | 5/1960 | Lanore | 131/84 C X |
| 3,096,772 | 7/1963 | Korber | 131/84 R X |
| 3,255,763 | 6/1966 | Hadley | 131/8 R X |
| 3,415,700 | 12/1968 | Webster | 198/193 X |
| 3,548,837 | 12/1970 | Cristiani | 131/84 B |
| 3,563,249 | 2/1971 | Geyer et al. | 131/84 B |
| 3,731,693 | 5/1973 | Pocock | 131/84 C X |

FOREIGN PATENTS OR APPLICATIONS

| | | | |
|---|---|---|---|
| 464,670 | 4/1950 | Canada | 131/84 R |
| 981,954 | 2/1965 | United Kingdom | 131/84 C |
| 331,333 | 7/1930 | United Kingdom | 131/84 C |

*Primary Examiner*—Robert W. Michell
*Assistant Examiner*—V. Millin
*Attorney, Agent, or Firm*—John C. Smith, Jr.

[57] ABSTRACT

Cigarettes are made with a filler comprising an outer annulus of tobacco surrounding a core of a tobacco or other material different from that in the outer annulus. The annulus tobacco is showered onto a conveyor to form a layer which is then bent into a U-section. Core material is fed into the longitudinal recess in the layer, after which further tobacco is showered on to the layer plus core to enclose the core in tobacco the core may be formed by showering the core material onto a separate conveyor which then feeds the core material into the recess in the first layer. Alternatively, the core material may be in the form of regularly spaced segments.

84 Claims, 40 Drawing Figures

MANUFACTURE OF CIGARETTES AND THE LIKE

This is a continuation-in-part of patent application Ser. No. 22,955, filed Mar. 26, 1970 and now U.S. Pat. No. 3,736,941, issued June 5, 1973.

This invention is concerned with the manufacture of cigarettes and other similar rod-like articles for smoking. For convenience the invention will be described in terms of cigarettes, but it should be understood that the invention is also applicable to other smoking articles which may not strictly be regarded as "cigarettes" but which nevertheless comprise a filler of tobacco particles enclosed in a wrapping. The term "tobacco" will be used for convenience, but it should be understood that this is intended to include tobacco substitutes suitable for use in cigarettes or the like.

This invention is particularly concerned with the manufacture of cigarettes of which the filler includes a core of material different from the annulus of shredded tobacco lying just within the wrapping. The basis for this is that the taste of a cigarette is determined primarily by the quality of the tobacco lying in an annulus close to the wrapping. Within this annulus the cigarette filler may include a core of different material, for example inferior tobacco or even a non-tobacco material, which would not greatly affect the smoker's appreciation of the cigarette.

According to this invention a layer of tobacco is formed on a conveyor and a stream of core material narrower than the tobacco is then placed or formed on the tobacco layer. The further tobacco is showered on to the first layer and core material to enclose the core material in an annulus of tobacco.

The core material fed on to the layer of tobacco may be in various forms. For example, it could be in the form of a continuous stream of particulate material (e.g. reconstituted tobacco or artificial tobacco). Another possibility is that the core material could be fed as a succession of spaced stream sections of particulate material to enable cigarettes to be made with end portions filled entirely with tobacco as will be described further on. Another possibility is that the core could be fed as a continuous coherent rod or rope or as a succession of spaced rod or rope sections.

Examples of core material for use according to this invention are: reconstituted tobacco which may be in the form of shredded particles or extruded strands; freeze-dried tobacco which may for example consist of a mixture of tobacco dust and shredded tobacco stem and other low-quality tobacco, and has been found to have a relatively high filling power; artificial tobacco comprising a tasteless cellulose, one example of which is that known by the trade name CYTREL and made by the Celanese Corporation.

Examples of apparatus for carrying out this invention are shown diagrammatically in the accompanying drawings. In these drawings.

Figure 1:
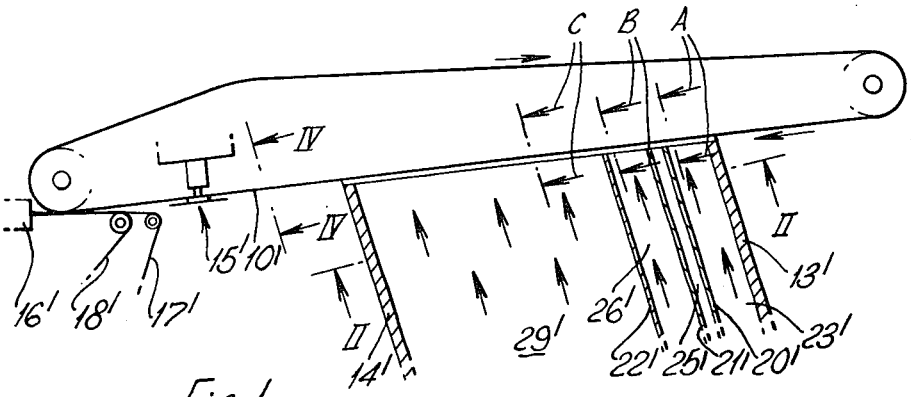
FIG. 1 is a fragmentary schematic view showing part of one cigarette-making machine.

The apparatus shown in FIG. 1 comprises an air-pervious suction band 10' which moves along the top of a narrow chimney defined by side walls 11' and 12' (FIG. 2) and end walls 13' and 14'. A cigarette filler (not shown) is built up beneath the suction band as it passes over the chimney, and after passing a trimmer 15' the filler is carried by the band into a garniture 16' in which the filler is enclosed in a continuous web of paper 17' carried by a garniture tape 18'. The filler is carried by the band 10' as a result of suction above the band; this suction is still present while the filler passes the trimmer 15', in which operation part of the filler is removed (namely the part 19' shown in FIG. 4) and the suction ends at the garniture so that the filler is allowed to drop on to the paper web.

Figure 3A:
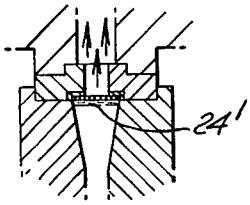
FIGS. 3A, 3B and 3C are fragmentary sections on the lines A, B and C in FIG. 1.
Figure 3B:
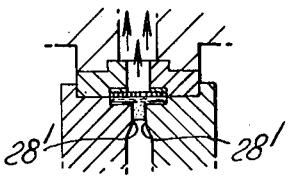
Figure 3C:
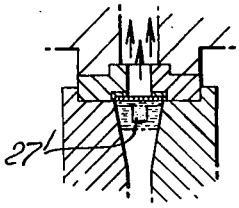

The chimney is divided into four compartments by internal walls 20', 21' and 22'. In the first of these compartments, identified as 23', shredded tobacco is carried upwards by air to form an initial layer 24' of tobacco on the suction band, as shown in FIG. 3A. This tobacco may comprise part or all of the tobacco removed by the trimmer; that is to say, the tobacco 19' (FIG. 4) removed by the trimmer may be fed to a small hopper (not shown) from which a measured quantity is fed continuously to the bottom of the compartment 23'. In the second compartment 25' lying between the internal walls 20' and 21', no further tobacco is carried, but air is allowed to flow upwards freely so as to assist in settling the initial layer 24' on the band before the band reaches the next compartment 26'. In the compartment 26', particles of core material are carried upwards by air to form a narrow layer 27' (see especially FIG. 4), this layer being narrow because of inwardly projecting parts 28' on the side walls of the chimney. It will be appreciated that the first layer 24' should as far as possible be allowed to settle firmly against the suction band before the band passes over the compartment 26', because the layer 24' must pass over the upper surfaces of the parts 28'; the clearance between the layer 24' and the parts 28' should preferably be as small as possible.

Figure 4:
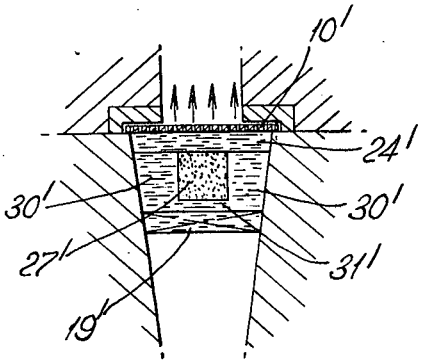
FIG. 4 is a fragmentary section on the line IV—IV in FIG. 1 on an enlarged scale showing the final filler as it is carried into the garniture by the suction band.

The last compartment 2' is the largest. During movement over this compartment, the suction band receives more tobacco to complete the enclosure of tobacco around the core 27' and to complete the tobacco stream as shown in section in FIG. 4; as shown in FIG. 4, the tobacco showered in the compartment 29' forms side portions 30' and a complete layer portion 31' which includes the part 19' which is subsequently removed by the trimmer 15'.

The amount of tobacco removed by the trimmer 15' may for example be 20 to 25% by weight of the total filler (i.e. before trimming). The core may for example form approximately 20% by weight of the filler after trimming.

The tobacco delivered to the bottom end of the compartment 23' to form the initial layer 24' may be part or all of the tobacco removed by the trimmer 15' and may be fed into the compartment 23' without further winnowing having previously been winnowed during delivery into the compartment 29', for example as described in U.S. Pat. No. 3,030,965.

Instead of the tobacco being showered upwards by means of air, as shown in FIG. 1, it could be showered downwards under gravity, with or without air assistance, on to a band running along the bottom of the shower channel as shown for example in FIG. 1 in U.S. Pat. No. 3,030,965.

Figure 5:
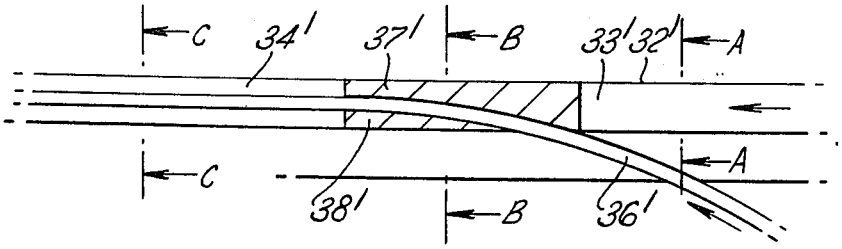
FIG. 5 is a view similar to FIG. 2, showing a modification.
Figure 6A:
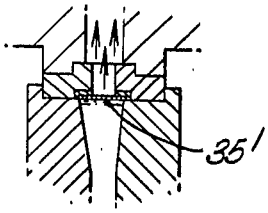
FIGS. 6A, 6B and 6C are sections on the lines A, B and C in FIG. 5.
Figure 6B:
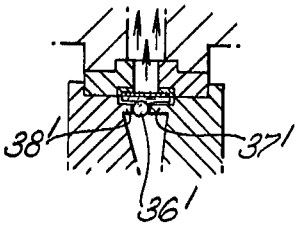
Figure 6C:
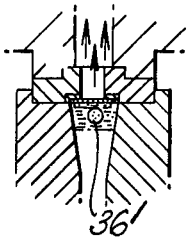

The apparatus shown in FIG. 5 also includes a suction band 32' which moves along the top of a chimney up which tobacco particles are carried by air (though it is again possible to use instead an inverted arrangement producing a downward shower under gravity). The chimney has two compartments 33' and 34'. In the compartment 33' a layer 35' of good shredded tobacco is built up on the suction band, as shown in FIG. 6A; this tobacco may be the discard from the trimmer (not shown) as in FIG. 1. In the compartment 34', a deeper layer of similar tobacco is built up in the same manner as in the previous example. In FIG. 5, however, the core is not built up within the chimney but is preformed and is carried in as a continuous rod 36' guided by stationary guides 37' and 38'. No tobacco is carried towards the suction band over the region of the guides 37' and 38'. Tobacco is showered through the compartment 34' so as to complete the formation of a filler as shown in FIG. 6C.

The core rod 36' may for example be extruded from reconstituted tobacco which may consist of tobacco dust with some tobacco shreds to provide a degree of cohesion. During cigarette manufacture the rod 36' may be drawn continuously from a bobbin.

Figure 7:
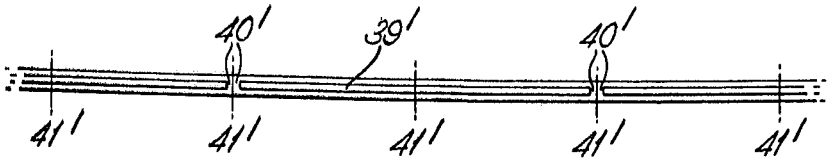
FIGS. 7 and 8 are longitudinal sections (unshaded for the sake of clarity) of two filler arrangements made by apparatus similar to that shown in FIG. 5.
Figure 8:
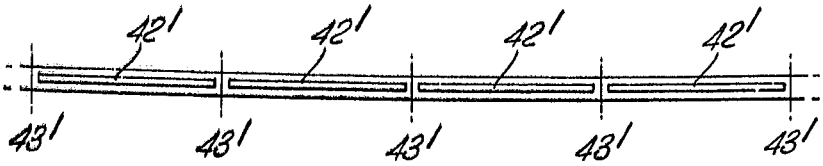
Figure 9:
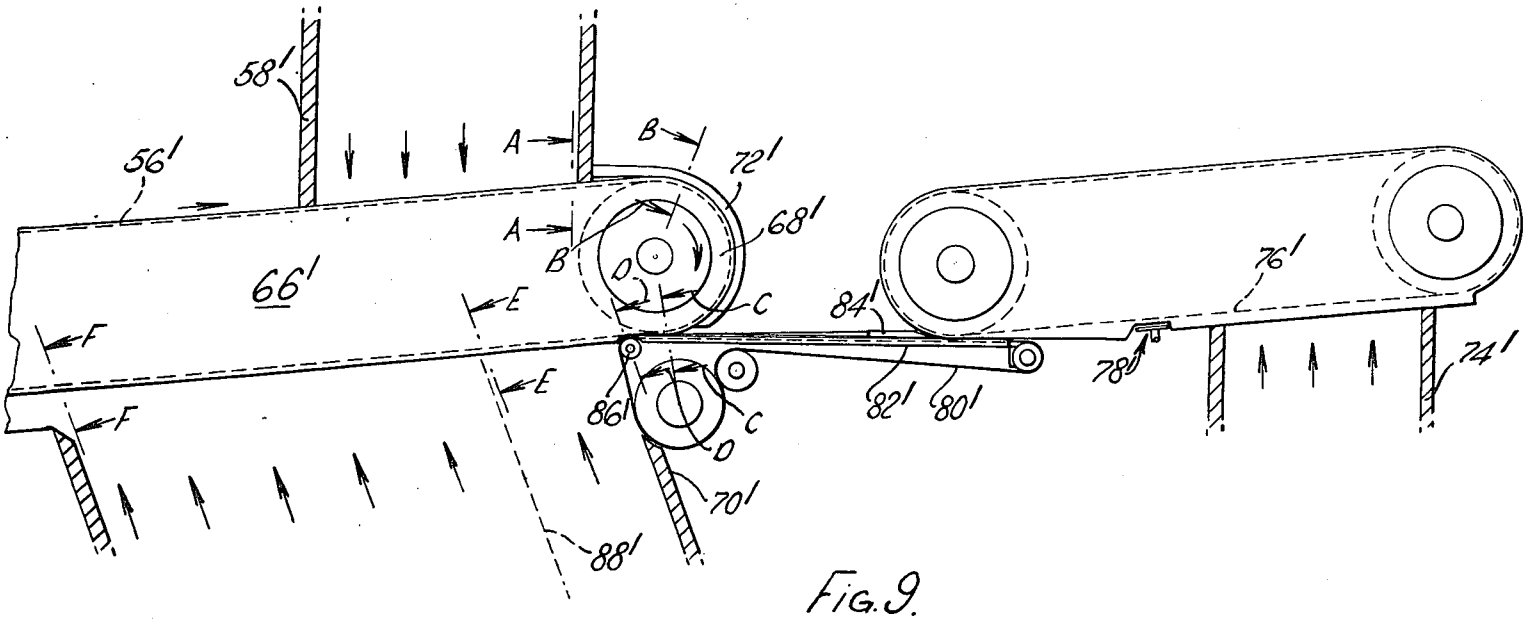
FIG. 9 is a diagrammatic view similar to FIG. 1 of another different machine.

As an alternative to a continuous core rod in FIG. 5, the apparatus may be arranged to feed precut sections of core rod so as to form a cigarette filler as shown in FIG. 7 or FIG. 8. FIG. 7 shows an arrangement particularly suitable for filter-tipped cigarettes; here each rod section 39' extends through two cigarette lengths of the filler, but stops short of one end of each cigarette length so as to leave end portions 40' which are of good tobacco. The filler is finally cut at lines 41', and it will be seen that each cigarette is thus formed with one "good" end and one end which will show the core. The good end is intended to be the un-tipped end of the cigarette (i.e. the end remote from the filter which subsequently is attached to form a complete filter-tipped cigarette) while the other end is intended to have any suitable form of filter tip. The good end portions 40' ensure that the smoker's first puff will be satisfactory; subsequently as the burning proceeds along the cigarette, the taste is determined by the quality of the annulus of tobacco around the core.

In FIG. 8, the core rod is fed in short sections 42' each of which ends short of the cut lines 43'. This is particularly suitable for un-tipped cigarettes. It will be appreciated that the core rods 39' and 42' should be fed in timed relation to the cutter which subsequently cuts the continuous cigarette rod on the lines 41' and 43' respectively.

FIGS. 9 and 10A to 10F show a different machine. A band 56' moves along the bottom of a chute 58' down which good tobacco is showered (preferably with the aid of a downward air flow) to build up an initial layer 60' of which the edges are turned up slightly by means of forming rails 62'. The band 56' runs on side walls 64' defining a suction chamber 66'; as a result of the suction the layer 60' is held firmly against the band 56'.

After leaving the chute 58', the band 56' passes round a pulley 68' and then continues along the top of chimney 70' and finally returns round a second roller (not shown). The cross-sections of the forming rails 62' change progressively from the shapes shown in FIG. 10A to the shapes shown in FIG. 10B, thus bending the edges of the layer 60' as shown to form approximately a U-shape. The width of the layer 60' during this part of the forming operation reduces for example from 12.5 mm (in FIG. 10A) to 8.5 mm (in FIG. 10B). This bending of the edges of the layer 60' is assisted by the centrifugal force, while a forming needle 72' (aided by suction through the band) holds the middle section of the layer against the band. A central slot 73' in the needle allows air to flow through the needle; alternatively the needle may be made of an air-pervious material. It will be appreciated that the interior 69' of the pulley 68' may form a continuation of the suction chamber 66' or may alternatively have increased suction if necessary.

Figure 10A:
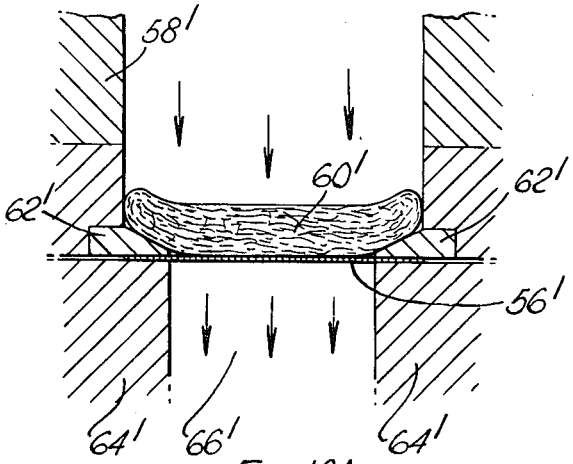
FIGS. 10A to 10F are enlarged sections on the lines A to F in FIG. 9.
Figure 10B:
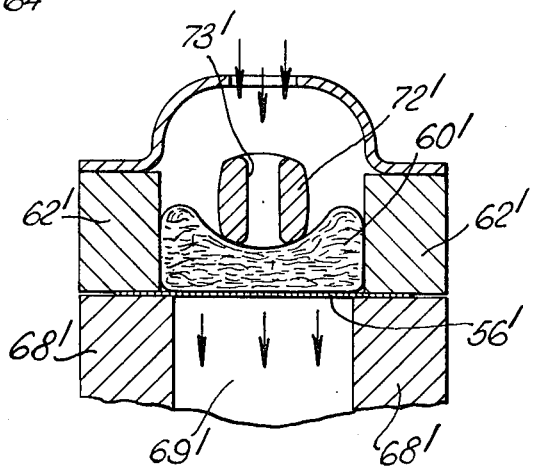
Figure 10C:
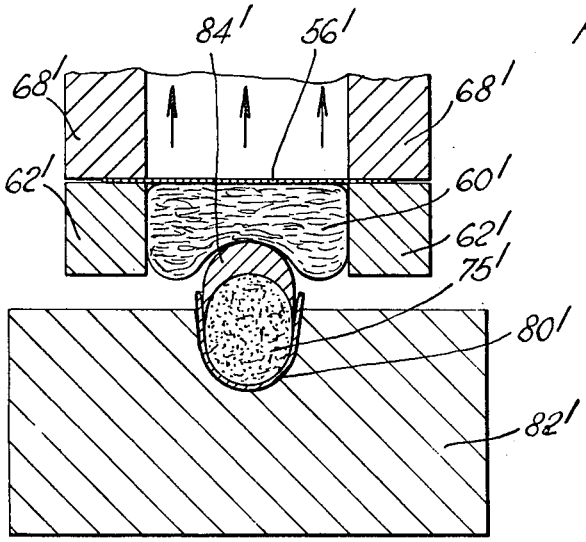

While the layer 60' is being formed into a U shape, a core is formed continuously for insertion into the U, as shown in FIG. 10C. This core is formed by showering core material (for example inferior quality tobacco) by means of air up a chimney 74' to build up a core stream 75' (see FIG. 10C). The core stream builds up against the undersurface of air-pervious band 76' and is carried by suction past a trimmer 78' and then transferred to a tape 80'. At the transfer point the tape is curved in section, being supported in a concave groove in a base block 82' (see particularly FIG. 10C). A scraper 84' helps to remove the core stream from the band 76', and an extension of the scraper serves as a tongue which progressively compresses the core stream into a slightly oval cross-section (see FIG. 10C). FIG. 10C shows the core stream 75' just before it is placed into the hollow of the tobacco layer 60'.

Figure 10D:
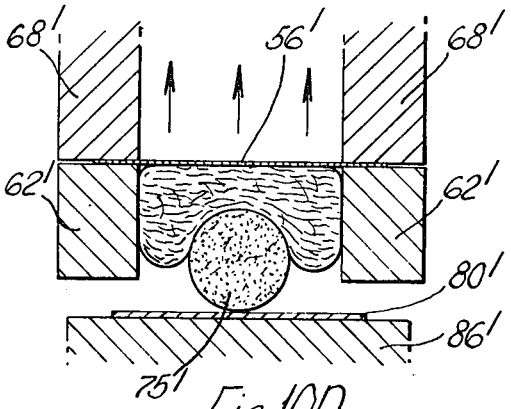

Just before it reaches a pulley 86' the tape 80' becomes flat to enable it to pass round the pulley 86', as shown in FIG. 10D.

It will be appreciated that the layer 60' remains with approximately the same cross-section while it passes round the pulley 68'. The middle of the layer is held against the band 56' with the assistance of the forming needle 72' until just before the section shown in FIG. 10C, where the tongue 84 ' enters the hollow of the layer 60' to guide the core stream 75' into position.

Air flow up the chimney 70' carries firstly a shower to tobacco shorts (for example to the right of the dotted line 88') to form a layer comprising mainly side portions 90' and 92' filling in the spaces on opposite sides of the core. During further movement to the left the partially formed filled carried (by suction) by the band 56' is completed by means of a shower of good tobacco (to the left of the dotted line 88'). Thus a layer 94' (FIG. 10F) is formed. Part of this layer is preferably removed at about the line 96' by means of a trimmer (not shown) which moves up and down automatically in response to signals from a filler monitoring system (for example as described in U.S. Pat. No. 3,089,497).

The tobacco fed into the chute 58' to form the initial layer 60' may be part or all of the tobacco removed by the trimmer (not shown) downstream of the chimney 70'.

Figure 10E:
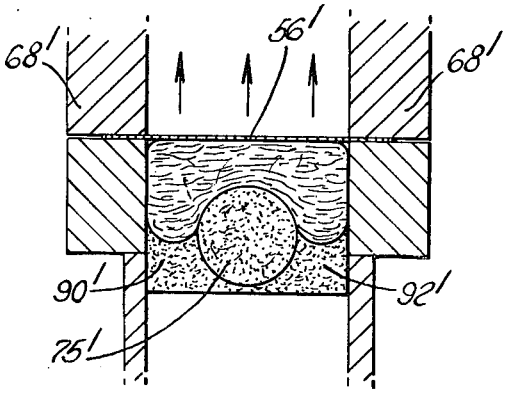
Figure 10F:
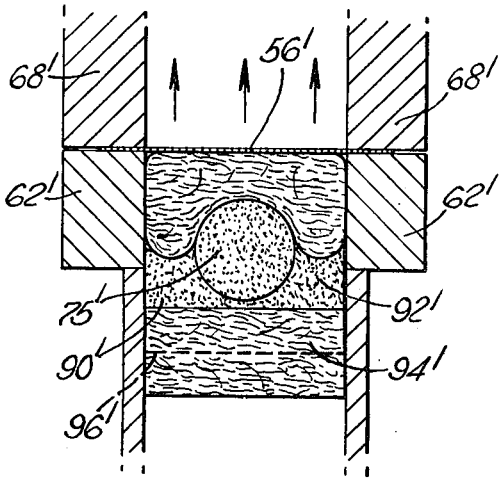
Figure 11:
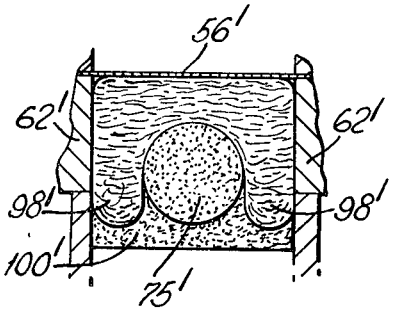
FIG. 11 is a section showing a modification of the filler section shown in FIG. 10E.

As an alternative the initial layer may be formed by the stage of FIG. 10B or 10C into a deeper U shape, as shown in FIG. 11, so as largely to avoid the side portions 90' and 92' which require to be formed by shorts in FIG. 10E. Moreover, the deeper side portions 98' of the modified initial layer shown in FIG. 11 give more support to the core 75'. With this arrangement an approximately flat layer 100' is formed by the shorts showered up the chimney 70'; alternatively the initial shorts feed may be omitted, and the chimney 70' may serve to shower only good tobacco. In order to achieve a deeper U section, as shown in FIG. 11, the initial width of the layer when substantially flat (i.e. as shown in FIG. 10A) may be increased.

Instead of the core being formed in the manner just described, it may be formed in some other manner, for example by extrusion, and may be fed into the hollow of the layer 60' in the manner described.

Instead of the initial layer 60' being bent into a U shape while passing round a pulley (i.e. with the aid of centrifugal force), it may be bent into a U shape by the action of the forming rails while moving along a straight path. In this case the shorts and tobacco feed which completes the cigarette filler (i.e. showered up the chimney 70') may instead be showered down a chute under gravity; any suitable means may be used to introduce the core between the two chutes.

FIGS. 12 to 18 show different embodiments of this invention.

Figure 15A:
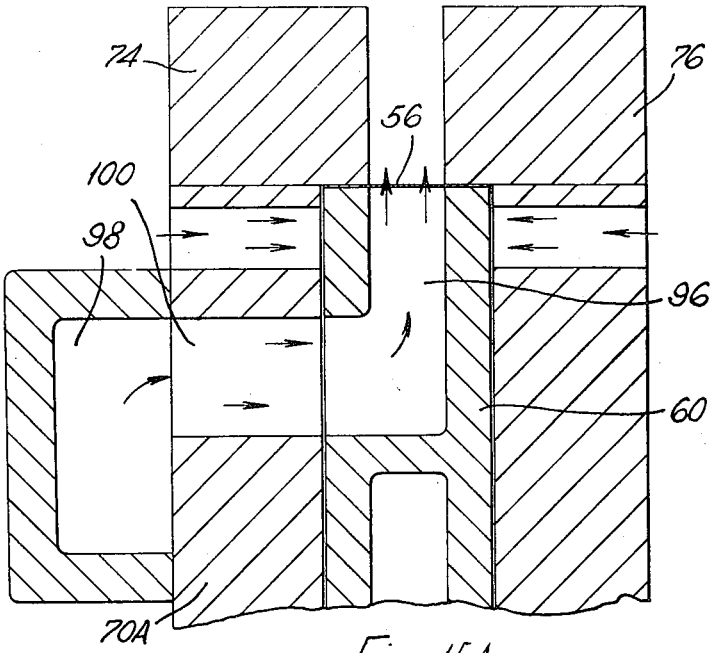
FIGS 15A to 15H, 15J and 15L are sections on the lines A–L in FIG. 12.
Figure 15B:
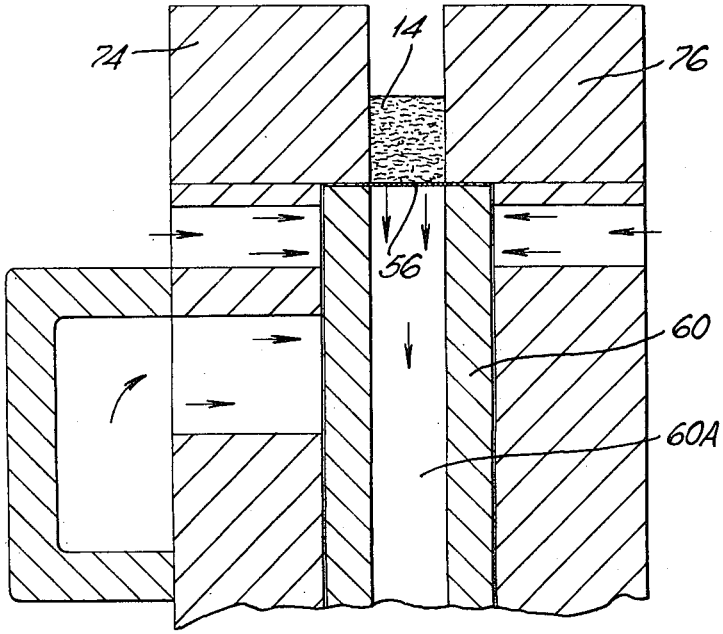
Figure 15C:
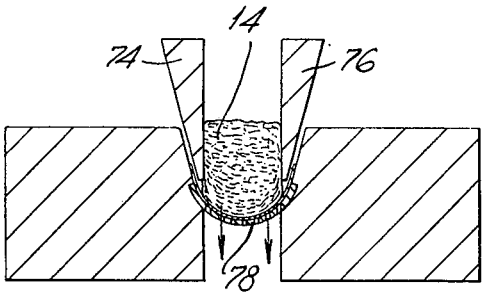
Figure 15D:
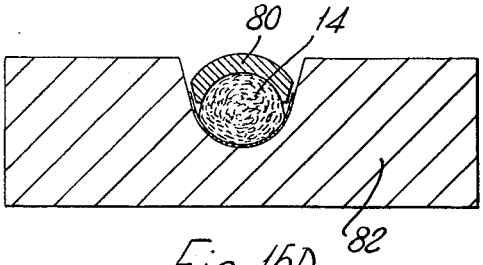
Figure 15E:
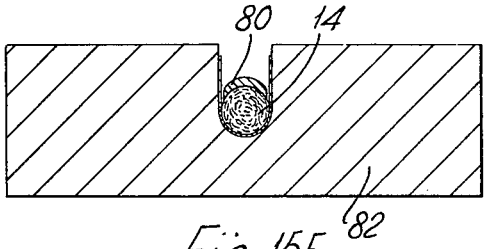
Figure 15F:
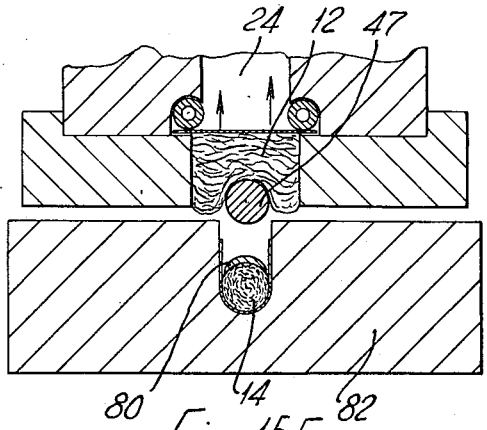
Figure 15G:
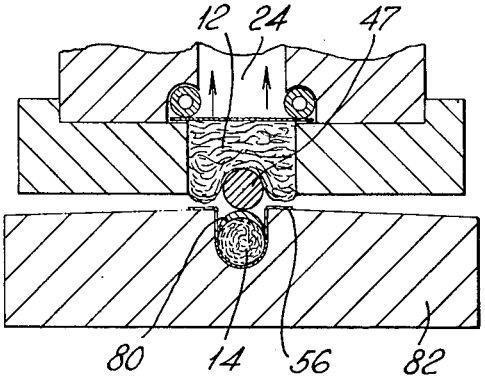
Figure 15H:
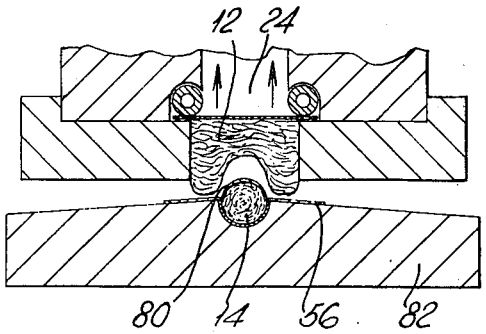
Figure 15J:
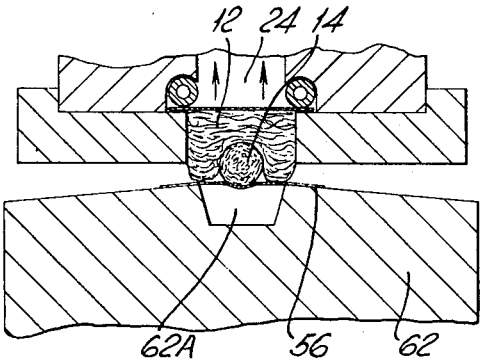
Figure 15L:
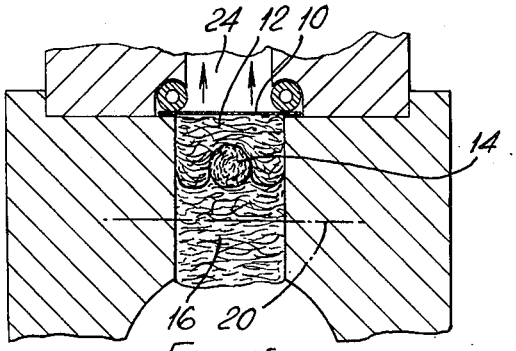

As shown in FIG. 15L, the complete cigarette filler stream, which is carried by an air-pervious band 10, consists of a first tobacco layer 12 of U-shaped cross-section, a core 14, and a second tobacco layer 16. Before the filler stream is placed on a web of cigarette wrapping material (not shown) it is trimmed by a trimmer 18 (FIG. 12) approximately at the level shown by the chain-dotted line 20 in FIG. 15L. The amount of tobacco removed by the trimmer is approximately 30% by weight of the total filler stream.

Figures 12, 12A:
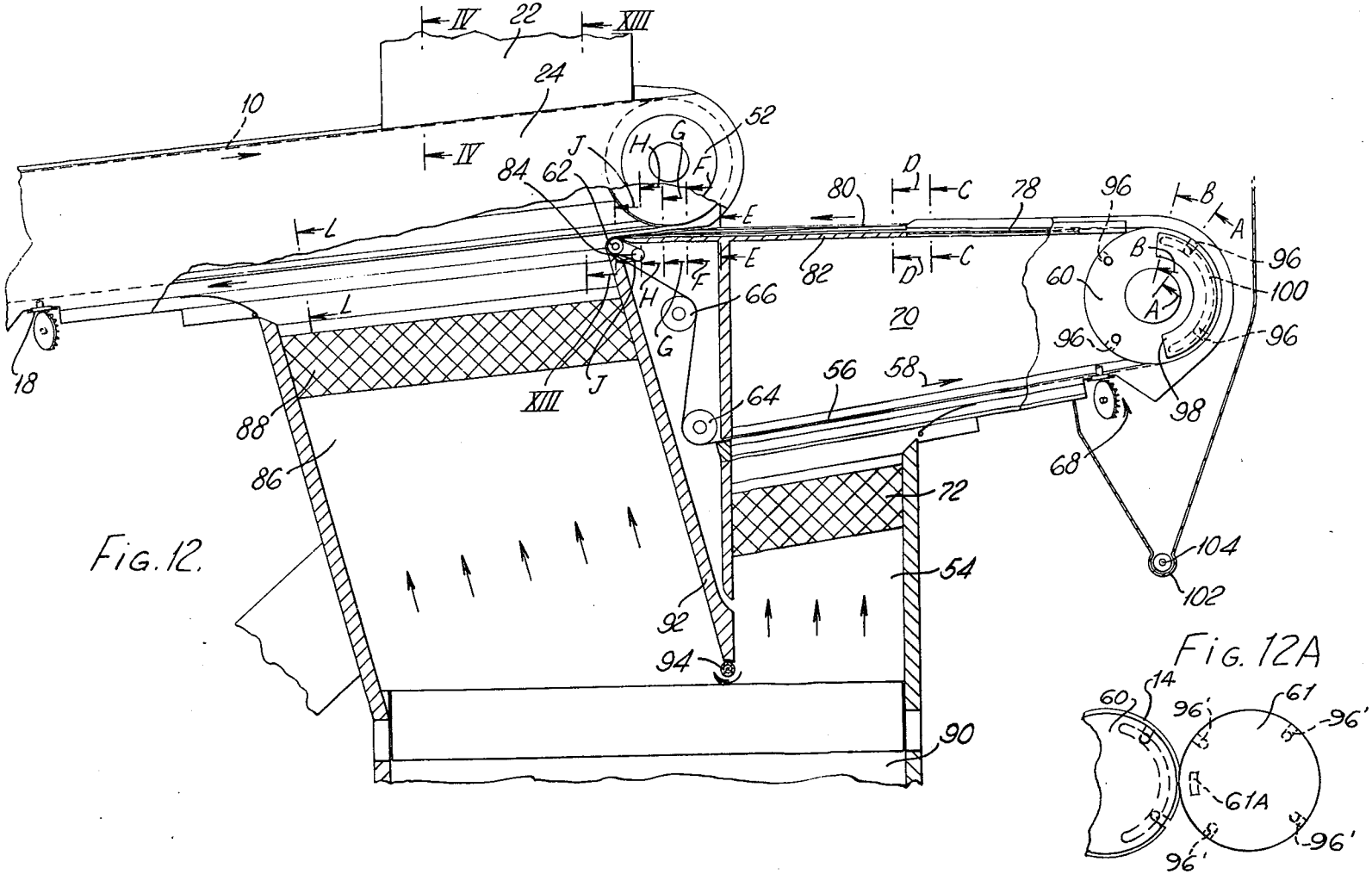
FIG. 12 is a fragmentary partly-sectioned elevation of the relevant part of another machine according to this invention.
FIG. 12A shows a modificaion of pat of FIG. 12.
Figures 13, 13A, 13B, 14:
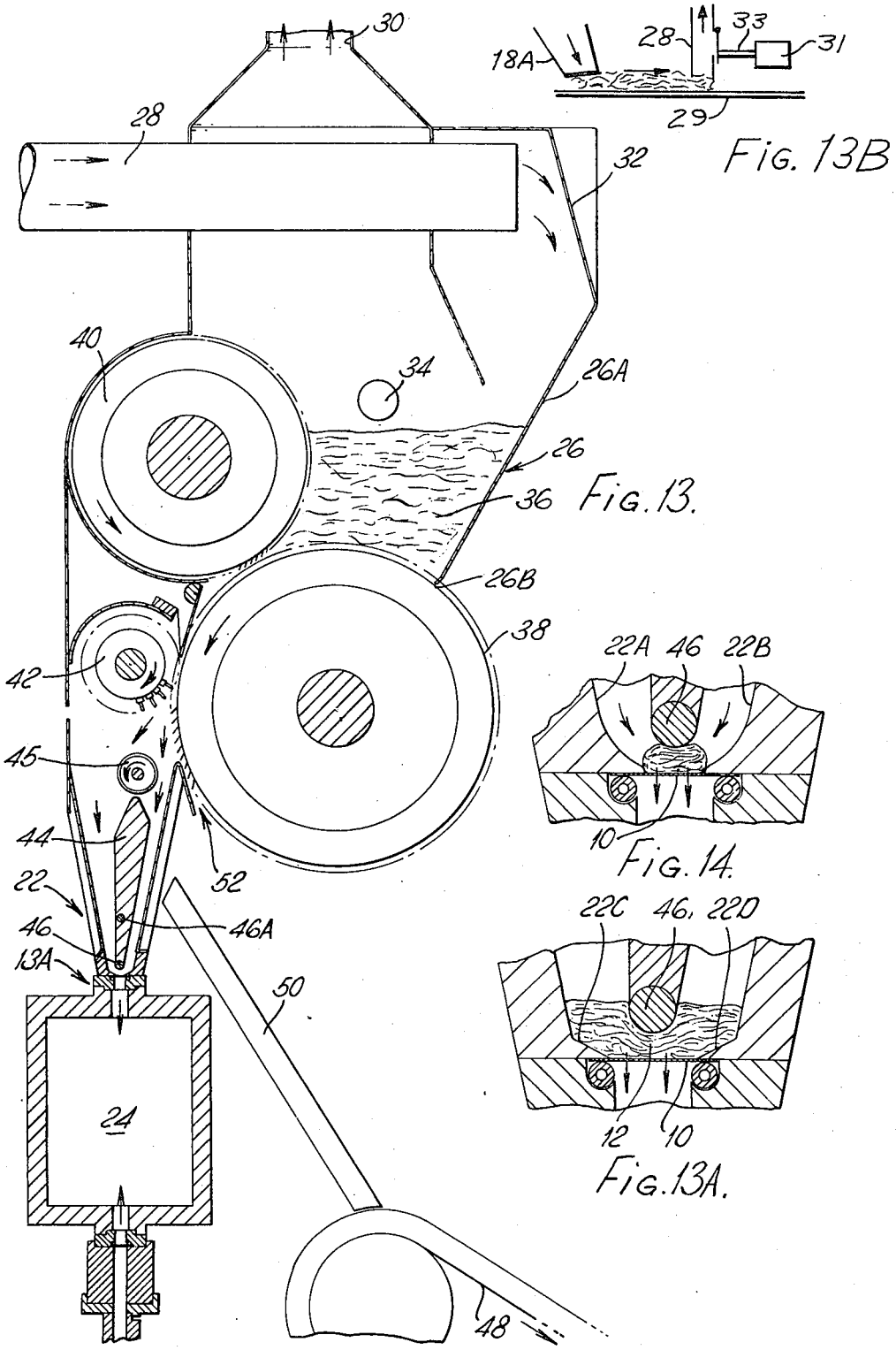
FIG. 13 is a section on the line XIII—XIII in FIG. 12, on a larger scale.
FIG. 13B shows diagrammatically the inlet end of a pipe which delivers discard tobacco into the hopper shown in FIG. 13.
FIG. 14 is a section similar to FIG. 13A but on the line IV—IV in FIG. 12.

As shown in FIGS. 12 and 13, the first tobacco layer is formed by showering tobacco down a chute 22 below which the upper run of the band 10 passes. Suction is applied through the band 10 from a suction chamber 24 so that air is drawn downwards through the band and helps the movement of tobacco through the chute, as well as packing the tobacco into a firm layer when it arrives on the band.

Tobacco is delivered to the chute 22 from a hopper 26 which is fed with tobacco through a pipe 28. The tobacco is carried through the pipe 28 by means of an air flow induced by a suction fan (not shown) connected to an air outlet 30. Thus the tobacco emerging from the pipe hits a plate 32 and then drops into the hopper, while the air is extracted through the outlet 30. The pipe 28 receives tobacco from a vibrating tray or other conveyor 29 on to which the tobacco removed by the trimmer 18 is delivered through delivery means 18A, all the tobacco fed into the pipe 28 being discard tobacco removed by the trimmer 18. The inlet end of the pipe (see FIG. 13) may for example be just above the vibrating tray or other conveyor 29 so that the tobacco is sucked upwards. A photo-cell device 34 is included to monitor the level of the mass of tobacco 36 in the hopper; for example, when the photo-cell device detects that the level has risen excessively, it may operate an actuator 31 which opens a flap 33 forming part of the wall of the pipe 28 near the vibrating tray, so that the pipe 28 then stops sucking up tobacco from the tray until the level in the hopper drops below the photo-cell whereupon the flap closes again to allow more tobacco to be sucked into the pipe.

A carded drum 38 carries a carpet of tobacco from the hopper with the aid of a refuser drum 40, and the carpet of tobacco is removed from the drum 38 by a picker roller 42 rotating, for example, at 900 r.p.m. so that the tobacco received from the drum 38 is projected downwards at a significant velocity. Within the chute 22 there is a flow splitter wall 44 above which there is a knurled roller 45 rotating for example at 1200 r.p.m. (or oscillating) to ensure that all the tobacco passes downwards along one or other side of the wall 44. The shape and position of the wall 44 together with the action of the roller 45 (the lateral position of which is horizontally adjustable) are such that the equal amounts of tobacco pass downwards along opposite sides of the wall 44; FIG. 14 shows how the tobacco at first forms a relatively narrow layer below the wall 44, the flow of tobacco to that position being facilitated by the shape of the side rails 22A and 22B at the bottom of the chute. The cross-section of the rails 22A and 22B changes progressively towards that shown in FIG. 13A as the tobacco layer 12 builds up further. As shown in FIG. 13A, the edges of the layer 12 are supported by triangular fillet portions 22C and 22D; extensions of these fillet portions beyond the chute 22 become progressively thicker so that their inner faces move progressively towards parallel positions to complete the formation of the U-shaped first layer as shown in FIG. 15L. As an alternative, in order to reduce the cost of machining the rails, rails of uniform cross-section (as shown in FIG. 14) may be used along say 125 mm of a chute having a width measured along the band of 300 mm, and may be followed by rails of uniform cross-section corresponding to FIG. 13A; i.e. giving an abrupt change of cross-section.

The bottom edge of the wall 44 is preferably formed by the bottom run of an endless band 46 of circular cross-section which moves in the same direction and at the same speed as the layer 12. The top run 46A of the band passes through the wall 44. A rod 47 (FIG. 15F) forms an extension of he band 46 downstream of the chute and helps to hold the middle of the layer 12 against the band 10 in the same manner as the forming needle 72 shown in FIG. 10B.

A back wall 26A of the hopper forms a crude air seal with the drum 38 at its bottom edge 26B, which is needed because the pressure in the hopper is below atmospheric. Any shorts which escape from the hopper at 26B fall on to a conveyor band 48 which carries the shorts away, together with any shorts or tobacco which slide down a ramp 50 after escaping through the gap 52 between the chute and the drum 38.

As shown in FIG. 12, after leaving the chute 22 the band 10 passes round a pulley 52. During the first 30° of movement round the pulley, the layer 12 of tobacco shown in FIG. 13A is progressively changed in cross-section towards the shape shown in FIG. 15L. The then inverted U-sectioned layer 12 carried by the lower run of the band 10 receives the core stream, the formation of which will now be described.

Core material, for example shreds of reconstituted tobacco, is showered up a passage 54 by means of an air flow upwards through the passage, so as to build up a layer of core material 14 on the underneath surface of a band 56. This band moves in the direction shown by the arrow 58 in FIG. 12 and passes round pulleys 60, 62 and 64, being tensioned by a tensioning pulley 66. Before the core stream reaches the pulley 60 it is trimmed by a trimmer 68 which may for example remove about 25% of the core material; FIG. 15B shows the approximate cross-section of the core stream after trimming. The band 56, which is of woven nylon, has edge portions with a close weave, and a substantial mid-region (of the same width as the core stream) which has a more open weave so that the band is significantly air pervious. Thus suction from a suction chamber 70 (FIG. 12) induces an air flow through the band in the region of the passage 54 and subsequently serves to hold the core stream on the band. A louvre port 72 in one wall of the passage 54 is connected to suction so as to increase the air flow up the passage 54, basically as described in U.S. Pat. No. 3,019,793.

In the region of the passage 54 and all the way to the top of the pulley 60 there are side rails 74 and 76 which confine the sides of the core stream. Soon after the core stream passes the top of the pulley 60 (i.e. on moving along the upper run of the band 56) the band 56 begins to become curved (concave) in cross-section and is supported by a perforated plate 78 (see particularly FIG. 15C) through which suction is applied from the suction chamber 70; in this region, the rails 74 and 76 become progessively narrower and sharper to enable the band to be formed into a U-shape. Then just befor stage D (see FIG. 15D) the rails 74 and 76 end, and the core stream passes under a tongue 80 while the band is supported by a non-pervious garniture base 82. The tongue and base progressively bend the band into a deeper U-shaped section and compress the core stream to the shape shown in FIG. 15E.

FIG. 15F shows the core stream 14 approaching the U-shaped first tobacco layer 12, while the core stream is still being compressed by the tongue 80, and the rod 47 is still lying in the hollow of the tobacco layer 12. FIG. 15G shows the core stream approaching still closer to the tobacco layer, and FIG. 15H shows the core stream (still compressed by the tongue 80) about to enter the hollow of the U-shaped tobacco layer. It wil be seen that the edges of the band 56 are progressively flattened from stage G to stage H, while FIG. 15J shows the band substantially flat while passing round the pulley 62. Compressed air is supplied to a groove 62A in the pulley through an inlet port 84 (FIG 12) so as to assist in removing the core stream from the band 56 and in placing it in the hollow of the tobacco layer 12; in other words, the core stream is blown off the band by air passing through the band from the groove 62A.

The second layer of tobacco 16 (FIG. 15L) is formed by showering tobacco upwards by means of air through a passage 86 (FIG. 12). Most of the air flow up the passage 86 is induced by suction applied through a louvre port 88 which functions like the louvre port 72 in the passage 54. Thus the thick layer 16 shown in FIG. 15L is built up and is carried from the passage 86 by the band 10. As already mentioned, the trimmer 18 removes about 30% of the total filler stream, that is to say approximately all the tobacco below the line 20 in FIG. 15L. The trimmed filler stream is then deposited by the band 10 on the continuous wrapper web (not shown) as in the Molins Mark 8 cigarette making machine as shown in U.S. Pat. No. 3,019,793.

Since the hopper 26 is fed only with tobacco removed by the trimmer 18, it is desirable to raise the trimmer 18 well above its normal mean position while the machine is being started; otherwise the trimmer 18 would not remove enough tobacco to form the first layer of tobacco 12. Preferred ways of doing this are described in U.S. Pat. No. Ser. No. 395,678, filed Sept. 10, 1973. As an alternative, however, the trimmer 18 could remain at or near its usual mean position during starting up, and the thickness of the layer of tobacco built up on the band from tobacco fed through the passage 86 could be increased; this could be achieved by temporarily slowing down the band 10, or by temporarily increasing the tobacco feed rate through the passage 86, or by a combination of both of these provisions.

Figure 2:
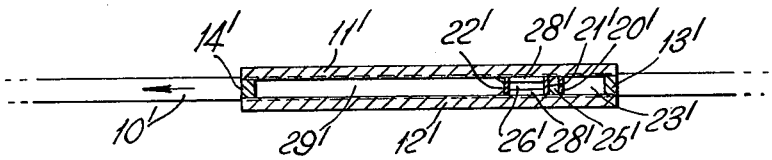
FIG. 2 is a section on the line II—II in FIG. 1, except that the width of the chimney (i.e. the small dimension) is shown exaggerated for the sake of clarity.

The core material and tobacco showered respectively up the passages 54 and 86 are initially delivered to the bottom end of a composite passage 90 basically in the manner shown in FIGS. 1 and 2 of U.S. Pat. No. 3,030,965, this being the system used in the Molins Mark 8 cigarette making machine. The total width of the passage 90 is approximately 609 mm, and of this width approximately 390 mm is used to feed tobacco (i.e. up the passage 86) while the remainder is used for core material. Both the tobacco and the core material ae winnowed in the manner described in U.S. Pat. No. 3,030,965.

Below the wall 92 itself there is a roller 94 (shown in cross section) which rotates about its axis in a clockwise direction so as to prevent any tobacco or core material catching on the bottom end of the wall 92.

Figure 18A:
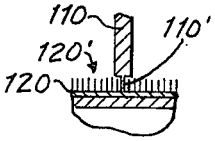
FIG. 18A is an enlarged sectional view taken on the line A—A of FIG. 18.
Figure 18:
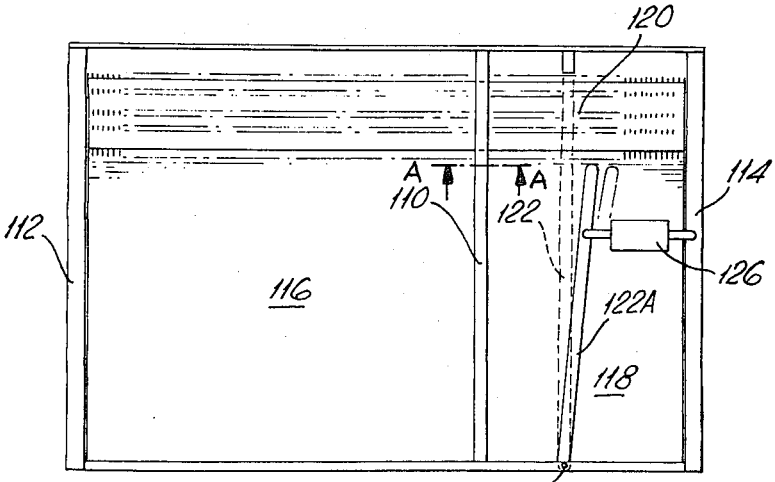
FIG. 18 is a plan view of the main hopper of the machine shown in FIG. 12.

FIG. 18 is a plan view of the tobacco container at the top of the main hopper from which tobacco and core material is fed to the passages 86 and 54. The hopper is basically like that of the Molins Mark 8 cigarette making machine, which is basically as shown in U.S. Pat. No. 3,062,357. The container (which is identified by the reference numeral 10 in the patent) is divided in the present case by a vertical partition wall 110 parallel to side walls 112 and 114 of the hopper to form two separate compartments 116 and 118 which correspond in width respectively to the passages 86 and 54. A ribbed or spiked conveyor 120 (identified in the patent as 11) carries tobacco and core material respectively from the compartments 116 and 118 and delivers it downwards into a hopper space below as described in the patent. From the hopper space tobacco and core material is carried out by the carded drum, which delivers carpets of tobacco and core material to the bottom end of the passage 90.

The tobacco and core material are carefully separated from one another in the hopper space by the partition wall 110. On each side of the partion wall in the hopper space there is a sensor to detect the height of the tobacco or core material. Each sensor may be in the form of a floating roller as shown in U.s. Pat. No. 3,062,357 (i.e. roller 31) but preferably comprises a photoelectric device of the well known sort. The photoelectric or other sensor responding to the height of the tobacco controls the speed of the conveyor 120. As this conveyor also serves to feed core material, an independent control is required for the core material in response to the photoelectric or other sensor in the part of the hopper space occupied by core material; this is described below.

In order to adjust the rate at which core material is fed to the passage 54 there is an adjustable vertical wall 122 on the core material side of the partition wall 110, the distance of the vertical wall 122 from the wall 110 being adjustable. Thus the space between the wall 122 and the wall 110 is kept substantially free of core material, though some core material might occasionally pass the wall 122 onto that space as the wall 122 cannot be arranged to provide a perfect seal with the moving parts of the hopper; the wall 110, however, has thin portions 110' adjacent to the conveyor 120 and carded drums which are arranged to enter between the spikes 120' on the conveyor and carded drums so as to provide a more effective seal.

The adjustable wal 122, which extends downwards into the hopper space below the container, provides a rough adjustment. For the purpose of further adjustment, the part 122A of the wall 122 which lies in the container space is formed as a separate part pivoted about a vertical axis at 124. A pneumatic jack 126 is connected between the side wall 114 and the pivoted wall part 122A. This jack is retracted automatically when the sensor indicates that the level of the core material in the hopper space is too high (e.g. so as to interrupt the light beam in the case of a photoelectric sensor), thus swinging the part 122A clockwise and reducing the width of the body of core material engaged by the conveyor 120. When the level of core material drops, the sensor allows the jack 126 to extend and thus increase the rate at which the conveyor 120 can feed core material out of the compartment 118. These operations are independent of the speed control of the conveyor 120 as previously described.

The core stream may be fed into the hollow of the U-sectioned first tobacco layer 12 as a continuous stream to form cigarettes of uniform cross-section. However, the drawings show a preferred arrangement by which short regular sections of the core stream are removed so as to form a continuous rod which in longitudinal section is shown in FIG. 7 or FIG. 8. For this purpose the pulley 60 has four circumferentially spaced radial ports 96 (see particularly FIG. 15A) which, while they are moving in contact with the band 56, communicate with a stationary manifold 98 via partcircular slot 100 in one wall 70A of the suction chamber 70. The manifold 98 is supplied with compressed air, so that air blows out through each port 96 to remove the short section of the core filler aligned with the port. This is assisted by centrifugal force throwing the short sections off the band. The remaining sections of the core stream are held on the band by suction from the chamber 70 which acts through a space 60A in the pulley 60 (see FIG. 15B).

It will be appreciated that the pulley 60 is driven with a peripheral speed equal to the speed of the band 56 and is timed so that the sections of the core stream which are removed are in the right positions in relation to the positions at which the finished cigarette rod is cut.

The core material thrown off by compressed air from the pulley 60, together with the material removed by the trimmer 68, falls into a trough 102 and is conveyed through the trough by a feed screw 104; alternatively it may be blown along the trough by a jet of air.

The removal of sections of the core stream 14 may be assisted by a suction wheel, 61 (see FIG. 12A) somewhat similar to the pulley 60, rotating about an axis parallel to that of the pulley 60 and with radial ports 96' through which timed sucks are applied from a manifold 61A so that the sections of the core stream are sucked into the radial ports of the suction wheel. Indeed the core sections could possibly be sucked off entirely by the action of the suction wheel 61 with the assistance of centrifugal force but without air being blown out of the pulley 60.

Figure 16:
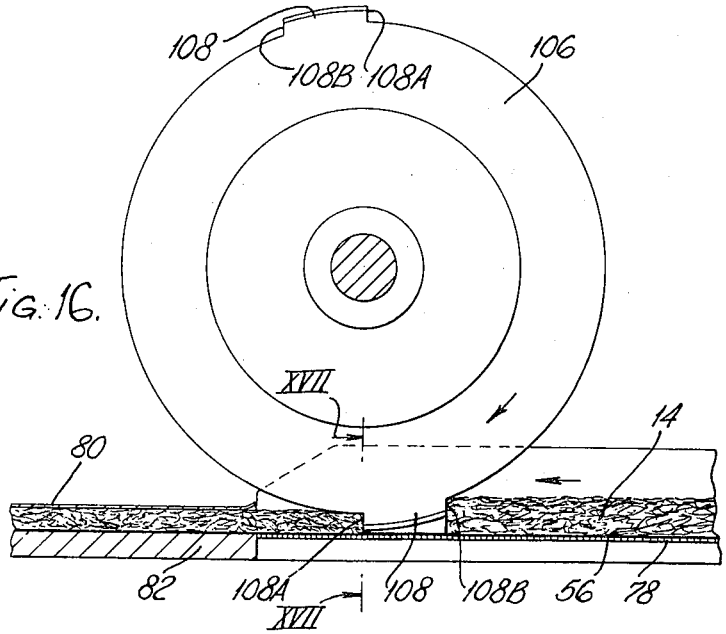
FIG. 16 is an enlarged sectional view showing a modification of part of the core-forming part of the apparatus shown in FIG. 12.
Figure 17:
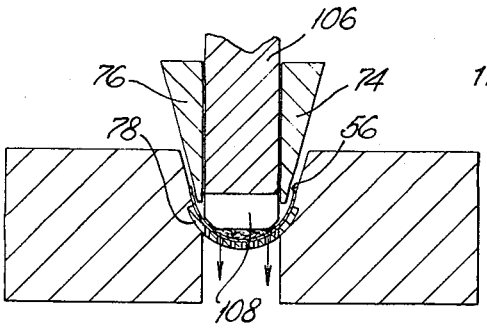
FIG. 17 is a section on the line XVII—XVII in FIG. 16 but on a larger scale.

FIG. 16 shows a preferred modification of the core-forming part of the apparatus shown in FIG. 12. The modification is immediately before the entry to the tongue 80 and comprises a compression wheel 106 which is formed with lobes 108. These lobes enter the gaps between successive sections of the core stream 14 and maintain the gaps while the core stream is being compressed by the wheel. It should be noted that the leading edge 108A of each lobe is radial, whereas the trailing edge 108B is not radial but is instead substantially parallel to the leading edge 108A.

The compression wheel compresses the core stream 14 from a height of 6 mm down to a height of 4 mm, thus reducing the work that needs to be done by the tongue 80 with regard to compression of the core stream. The compression wheel rotates at a speed such that the peripheral speed of the main part of the wheel (i.e. disregarding the lobes) equals the speed at which the core stream is carried by the band 56.

The core stream sections thrown off the pulley 96 may, for example, each be 12 mm long and may be at say 130 mm intervals. The cut-off of the machine (not shown) may then cut the finished continuous rod through the middle of each 12 mm section; that is, through each section in the final rod which is completely filled with tobacco. Each 130 mm long rod thus formed has both ends completely filled with tobacco and may be fed to a conventional filter-attachment machine which cuts the rod in the middle, moves the two halves apart, inserts a double-length filter between them, joins all the parts together by means of a "cork" strip, and finally cuts the assembly through the middle to form two separate filter-tipped cigarettes.

In the finished cigarette rod the weight per unit length of the core (excluding the sections where the core is removed) may for example be 25% of the whole cigarette filler. The first layer of tobacco may comprise 40% of the whole filler, while the second layer after trimming comprises 35% of the whole filler. As already mentioned, the final trimmer 18 removes 30% of the complete filler stream, i.e 50% by weight of the finished cigarette filler. Thus the trimmer 18 removes more tobacco (50% minus 40%) than is needed to form the first layer. The excess is fed into the tobacco compartment 116 of the main hopper (FIG. 18).

The suction levels in the suction chambers 24 and 170 are approximately the same at about 45 to 50 cms water gauge. The bands 10 and 56 have degrees of porosity equivalent to K factors respectively of 0.012 and 0.019.

We claim:

1. A machine for making a continuous cigarette rod having a central portion of core material surrounded by an annulus portion of tobacco, comprising a conveyor arranged for movement along a predetermined path, means for showering tobacco onto said conveyor to form a first layer of tobacco on the conveyor, a flow-splitting wall which extends along the conveyor and has an edge which is spaced from the middle of the conveyor by a predetermined distance for maintaining a predetermined thickness of the middle of the tobacco layer, said showering means being adapted to shower substantially equal quantities of tobacco along opposite sides of the flow-splitting wall, and means along said path downstream of said showering means for feeding core material onto and along said middle of the tobacco layer.

2. A cigarette rod making machine according to claim 1 wherein said flow-splitting wall includes an endless band, one run of which extends along the edge of said wall adjacent to the conveyor and is arranged to move in the same direction and at the same speed as the conveyor.

3. A cigarette rod making machine according to claim 2 in which the endless band is of circular cross-section.

4. A cigarette rod making machine according to claim 1 in which said wall includes a further edge remote from the conveyor, said machine including a rotating roller mounted along the edge of the wall remote from the conveyor to ensure that showered tobacco does not catch on that edge of the wall.

5. A cigarette rod making machine according to claim 4 in which the lateral position of the roller is adjustable to provide control over the proportions of tobacco passing along opposite sides of the wall.

6. A cigarette rod making machine according to claim 1 in which the conveyor is air-pervious, said machine further comprising means for applying suction through the conveyor to hold the tobacco layer on the conveyor.

7. A cigarette rod making machine according to claim 6 including a rod forming an extension of the edge of the flow-splitting wall downstream of the location along said conveyor said tobacco is showered on said conveyor, and means for bending the tobacco layer about the rod into a U-shaped cross-section with a longitudinal recess therein.

8. A cigarette rod making machine according to claim 7 in which the conveyor comprises a porous band and at least one pulley about which said band passes, and in which said bending means is adapted to bend to tobacco layer into a U-shaped cross-section in the region where the band approaches said pulley.

9. A cigarette rod making machine according to claim 8 in which said core material feeding means is adapted to feed a stream of core material directly into the longitudinal recess of the U-shaped first layer downstream of the pulley, said core material feeding means comprising a further core-feeding air-pervious band and means for showering particles of core material onto said band to form said stream of core material.

10. A cigarette rod making machine according to claim 9 in which the air pervious band is of woven nylon.

11. A cigarette rod making machine according to claim 9 further comprising means for curving said further core-feeding air-pervious band to a concave cross-section to shape said stream of core material into an approximately circular cross-section and a tongue, concave in cross-section, for compressing the stream of core material.

12. A cigarette rod making machine according to claim 11 including, immediately upstream of the tongue along said further core-feeding air-pervious band, a compression wheel for reducing the cross-sectional area of the stream of core material.

13. A cigarette rod making machine according to claim 12 in which said core material feeding means is adapted to feed said core material as a succession of spaced sections past the compression wheel and in which the compression wheel includes lobes for entering between said succession of spaced sections of said stream of core material to maintain the spacing between said successive sections.

14. A cigarette rod making machine according to claim 9 in which said showering means is adapted to shower the tobacco downwards to form the first tobacco layer on the porous conveyor band upstream of said pulley, said conveyor band being arranged to pass through substantially 180° round the pulley to provide a substantially horizontally moving lower run, said further core-feeding air-pervious band of said core material feeding means including substantially horizontally moving upper and lower runs, said upper run being arranged to feed said stream of core material into said longitudinal recess in said first layer on said lower run of said conveyor band, said core-feeding means further comprising a shower passage for directing an air stream containing the core material onto said lower run of said further core-feeding air-pervious band, and said tobacco feeding means including a second shower passage for directing a further air stream containing said tobacco onto said core material on said first layer to form a final tobacco layer.

15. A cigarette making machine according to claim 14 in which the two shower passages are adjacent to one another, said machine further comprising a common hopper including a plurality of feed parts for feeding both core material and tobacco to said respective shower passages.

16. A cigarette rod making machine according to claim 1, wherein said core material feeding means comprises means for first forming a continuous core stream and a pneumatic device for pneumatically removing regularly spaced portions of the continuous core stream leaving a succession of core stream sections spaced from each other and consisting of particulate material for feeding in succession onto said first layer of tobacco.

17. A machine for making a continuous cigarette rod having a central portion of core material surrounded by an annulus portion of tobacco, including means for forming a continuous stream of particulate core material, means for conveying the continuous core stream along a path, a pneumatic device arranged along said path for removing regularly spaced portions of the continuous core stream leaving a succession of core stream sections spaced from each other, and means for forming a continuous filler stream by enclosing said succession of spaced core stream sections in tobacco.

18. A cigarette rod making machine according to claim 17 in which said conveying means comprises an air-pervious conveyor band and means for applying suction through the conveyor band, and in which the pneumatic device comprises a pulley, said conveyor band being arranged to pass thereabout, said pulley having a plurality of circumferentially spaced ports on its periphery through which said suction is applied to hold said succession of spaced sections of the core stream on the band while said regularly spaced portions of the core stream are removed pneumatically and with the aid of centrifugal force.

19. A cigarette rod making machine according to claim 18 in which the pulley has a plurality of further circumferentially spaced ports, said pneumatic device including means for blowing air through said further ports to assist in removing said regularly spaced portions of the core stream.

20. A cigarette rod making machine according to claim 16 including a trimmer to trim any excess of said core material from the continuous core stream before said sections are removed.

21. A machine for making a continuous cigarette rod having a central portion of particulate core material surrounded by an annulus portion of tobacco, said machine including a core conveyor, means for forming a layer of said particulate core material having a first predetermined width on said core conveyor, a tobacco conveyor, means for forming a layer of tobacco having a second predetermined width greater than said first predetermined width on said tobacco conveyor, said core conveyor being arranged to feed said core material layer onto and along the middle of said layer of tobacco carried by said tobacco conveyor such that the side edges of said core material layer are laterally spaced inwards from the side edges of said layer of tobacco, and means for subsequently forming a further layer of tobacco on the core material layer and layer of tobacco at opposite sides of said core material layer to surround the core material with tobacco.

22. A machine for making a continuous cigarette rod having a central portion of particulate core material surrounded by an annulus portion of tobacco, said machine including a core conveyor, means for showering said particulate core material onto said core conveyor, a tobacco conveyor, means for forming a layer of said tobacco on said tobacco conveyor, said core conveyor being arranged to feed said core material onto and along the middle of said layer of tobacco carried by said tobacco conveyor, and means for subsequently feeding further tobacco along the core material and layer of tobacco on said tobacco conveyor to surround the core material with tobacco, said core conveyor including a flexible air-pervious band adapted to carry core material along a path, suction means for applying suction through the band as the core material is carried along at least a part of said path, a region of said path immediately upstream of the point at which the core material is transferred to the tobacco layer being curved to a concave cross-section, and a tongue of concave cross-section and arranged to progressively compress the core material at said region towards a substantially circular cross-section.

23. A method of making a continuous cigarette rod including a core surrounded by an annulus of tobacco, said method comprising showering tobacco onto a conveyor along opposite sides of a flow-splitting wall extending along the conveyor to form a layer of tobacco in which the sides of the layer are built up separately from the tobacco showered along opposite sides of the flow-splitting wall, feeding core material along the conveyor and at least partly enclosing the core material in said layer of tobacco.

24. A method according to claim 23 including the step of setting the thickness of a middle portion of the layer of tobacco to a predetermined thickness by means of an dge of the flow-splitting wall lying parallel to but slightly spaced from the conveyor, said core material being fed onto and along said middle portion, and feeding further tobacco along the core to surround the core with tobacco.

25. Apparatus for making a cigarette filler stream, comprising a. support means movable along a predetermined path, b. first means for forming an initial layer of tobacco particles having a predetermined width on said support means at a first position along said path, c. second means for forming a core layer of core material having a narrower width than said initial layer on said initial layer at a second position along said path downstream of said first position such that the side edges of said core layer are laterally spaced inwards from the side edges of the said initial layer, and d. third means for forming a third layer of tobacco particles on said core layer and on said initial layer at opposite sides of said core layer at a third position downstream of said second position, eo whereby a cigarette filler stream is formed comprising an outer annulus of tobacco particles surrounding a core material.

26. Apparatus according to claim 25 wherein said first means for forming said initial layer comprises means for showering tobacco particles onto said moving support and said third means for forming said third layer comprises means for showering tobacco particles on said core layer and initial layer at opposite sides of said core layer.

27. Apparatus according to claim 25 wherein said second means for forming said core layer comprises means for feeding a pre-formed core rod onto said initial layer.

28. Apparatus according to claim 25 further comprising means for directing air through said initial layer and supporting means at a position between said first and second positions to settle said initial layer.

29. Apparatus according to claim 25 further comprising between said first and second positions, forming means for bending the opposite longitudinal sides of said initial layer towards each other to form a concave surface in said initial layer for receiving said core layer therein.

30. Apparatus according to claim 29 wherein said forming means comprises a pair of forming rails having surfaces for contacting and progressively bending the opposite longitudinal sides of said initial layer as said initial layer moves along said path.

31. Apparatus for making a cigarette filler stream, comprising:

a. support means movable along a predetermined path past first, second and third positions in succession, b. first means for forming an initial layer of tobacco particles on said support means at said first position along said path, said initial layer having a predetermined width, c. a pair of forming rails between said first and second positions and having surfaces for contacting and progressively bending, as said initial layer moves along said path, the opposite longitudinal sides of said initial layer towards each other to form a concave surface in said initial layer, d. second means for forming a core layer of core material on said concave surface of said initial layer at said second position along said path downstream of said first position, said core layer having a narrower width than said initial layer and having its side edges laterally spaced inwards from the side edges of said initial layer, e. at least a part of the path of said support means between said first and third positions being circular, whereby centrifugal force helps in the said progressive bending of the longitudinal sides of the initial layer, and f. third means for forming a third layer of tobacco particles on said core layer and on said initial layer at opposite sides of said core layer at said third position downstream of said second position, g. whereby a cigarette filler stream is formed comprising an outer annulus of tobacco particles surrounded by a core material.

32. Apparatus for making a cigarette filler stream, comprising:

a. support means movable along a predetermined path past first, second and third positions in succession, b. first means for forming an initial layer of tobacco particles on said support means at said first position along said path, said initial layer having a predetermined width, c. forming means for bending the opposite longitudinal sides of said initial layer towards each other to form a concave surface in said initial layer, said forming means including an elongated needle spaced from said support means for contacting the surface of an intermediate longitudinal portion of the initial layer while said opposite longitudinal sides are bent, d. second means for forming a core layer of core material on said concave surface of said initial layer at said second position along said path downstream of said first position, said core layer having a narrower width than said initial layer and having its side edges laterally spaced inwards from the side edges of the said initial layer, and e. third means for forming a third layer of tobacco particles on said core layer and on said initial layer at opposite sides of said core layer and said third position downstream of said second position, f. whereby a cigarette filler stream is formed comprising an outer annulus of tobacco particles surrounded by a core material.

33. Apparatus according to claim 29 wherein said second means for forming said core layer comprises a conveyor movable along a second path, means for showering said material onto said conveyor to form a core stream, and transfer means for receiving said core stream and for feeding it onto the concave surface in said initial layer.

34. Apparatus for making a cigarette filler stream, comprising:

a. support means movable along a predetermined path past first, second and third positions in succession, b. first means for forming an initial layer of tobacco particles on said support means at said first position along said path, said initial layer having a predetermined width, c. forming means between said first and second positions for bending the opposite longitudinal sides of said initial layer towards each other to form a concave surface in said initial layer, d. second means for forming a core layer of core material on said concave surface of said initial layer at said second position along said path downstream of said first position, said core layer having a narrower width than said initial layer and having its side edges laterally spaced inwards from the side edges of the said initial layer, said second means comprising a conveyor movable along a second path, means for showering said material onto said conveyor to form a core stream, and transfer means for receiving said core stream and for feeding it onto the concave surface of said initial layer, said transfer means comprising a tape movable partly along said second path for receiving said core stream, means for controlling the cross-sectional shape of said tape as it moves along said second path, and compression means spaced from said tape for progressively compressing said core stream towards said tape as it moves along said second path, and e. third means for forming a third layer of tobacco particles on said core layer and on said initial layer at opposite sides of said core layer at said third position downstream of said second position, f. whereby a cigarette filler stream is formed comprising an outer annulus of tobacco particles surrounding a core material.

35. Apparatus according to claim 29 wherein said third means comprises means for first showering a layer of tobacco shorts on said core layer and initial layer at opposite sides of said core layer and then showering a layer of a different quality tobacco on said shorts layer.

36. A method for making a cigarette filler stream comprising a. forming an initial layer of tobacco particles having a predetermined width on a moving support, b. forming a core layer of material having a narrower width than said initial layer on said initial layer, such that both side edges of said core layer are laterally spaced inwards from the edges of the said initial layer, and c. forming a third layer of tobacco particles on said core layer and on said initial layer at opposite sides of said core layer, d. to form a cigarette filler stream comprising an outer annulus of tobacco surrounding a core of material different from that in said outer annulus.

37. The method according to claim 36 wherein said step of forming said initial layer comprises showering tobacco onto said moving support and said step of forming said third layer comprises showering tobacco on said core layer and initial layer at opposite sides of said core layer.

38. The method according to claim 37, wherein the step of forming a core of material on said initial layer comprises feeding said core layer as a continuous rod onto said initial layer.

39. A method for making a cigarette filler stream comprising:

a. forming an initial layer of tobacco particles on a moving support by showering said tobacco particles onto said moving support, said initial layer having a predetermined width, b. feeding a core layer of material in the form of a plurality of rods of predetermined length onto said initial layer in succession at spaced intervals, said core layer having a narrower width than said initial layer and having both its side edges laterally spaced inwards from the edges of the said initial layer, and c. forming a third layer of tobacco particles by showering said tobacco particles on said core layer, on said initial layer at opposite sides of said core layer and in the spaced intervals between the ends of said rods whereby said core layer is not visible when said filler stream is severed intermediate the ends of adjacent rods, d. to form a cigarette filler stream comprising an outer annulus of tobacco surrounding a core of material different from that in said outer annulus.

40. The method according to claim 37, further comprising directing air through the initial layer before said core layer is applied to settle said initial layer.

41. A method for making a cigarette filler stream comprising:

a. forming an initial layer of tobacco particles on a moving support by showering said tobacco particles onto said moving support, said initial layer having a predetermined width, b. bending the opposite longitudinal sides of the initial layer towards each other with the aid of centrifugal force while retaining the intermediate longitudinal portion of the initial layer between said opposite sides against the support means to form a concave surface in said initial layer, c. forming a core layer of material on the concave surface of said initial layer, said core layer having a narrower width than said initial layer and having both its side edges laterally spaced inwards from the edges of said initial layer, and d. forming a third layer of tobacco particles by showering tobacco particles on said core layer and on said initial layer at opposite sides of said core layer, e. to form a cigarette filler stream comprising an outer annulus of tobacco surrounding a core of material different from that in said outer annulus.

42. Apparatus for making a cigarette filler stream, comprising a. support means movable along a predetermined path, b. first means for forming an initial layer of tobacco particles having a predetermined width on said support means at a first position along said path, c. second means for feeding a pre-formed core stream having a narrower width than said initial layer onto said initial layer at a second position along said path downstream on said first position, and d. third means for forming by means of showering a second layer of tobacco particles on said core stream and on said initial layer at opposite sides of said core stream at a third position downstream of said second position, e. whereby a cigarette filler stream is formed comprising an outer annulus of tobacco surrounding the core stream.

43. Apparatus for making a cigarette filler stream, comprising a. support means movable along a predetermined path b. first means for forming an initial layer of tobacco particles on said support means at a first position along said path by showering tobacco particles onto said support means, said initial layer having a predetermined width, c. second means for feeding a succession of axially spaced core layer sections of predetermined length on to said initial layer at a second position along said path downstream of said first position, said core layer sections having a narrower width than said initial layer, and d. third means for forming by showering a second layer of tobacco particles on said core layer sections, and in the spaces between the ends of said core layer sections, and on said initial layer at opposite sides of said core layer, said third means being at a third position downstream of said second position, e. whereby a cigarette filler stream is formed comprising an outer annulus of tobacco surrounding spaced core layer sections, which core layer sections are not visible when said filler stream is severed intermediate the ends of adjacent core layer sections.

44. Apparatus for making a cigarette filler stream, comprising a. support means movable along a predetermined path, b. means forming an initial layer of tobacco particles on said support means at a first position along said path, said initial layer having a predetermined width, c. means at a second position along said path downstream of said first position for bending the opposite longitudinal sides of said initial layer towards each other to form a concave surface in said initial layer, said forming means comprising a pair of forming rails having surfaces for contacting and progressively bending the opposite longitudinal sides of said initial layer as said initial layer moves along said path, at least a part of the path of said support means being circular whereby centrifugal force helps in the said progressive bending of the longitudinal sides of the initial layer, d. means at a third position downstream of the said second position for feeding a core layer of core material into said concave surface of said initial layer, said core layer having a narrower width than said initial layer, and e. means for forming a second layer of tobacco particles over said core layer and over said initial layer at opposite sides of said core layer at a fourth position downstream of said third position, whereby a cigarette filler stream is formed comprising an outer annulus of tobacco surrounding the core material.

45. Apparatus for making a cigarette filler stream, comprising a. support means movable along a predetermined path, b. means forming an initial layer of tobacco particles on said support means at a first position along said path, said initial layer having a predetermined width, c. means at a second position along said path downstream of said first position for bending the opposite longitudinal sides of said initial layer towards each other to form a concave surface in said initial layer, and including an elongated needle spaced from said support means for contacting the surface of an intermediate longitudinal portion of the initial layer while said opposite longitudinal sides are bent, d. means at a third position downstream of the said second position for feeding a core layer of core material into said concave surface of said initial layer, said core layer having a narrower width than said initial layer, and e. means for forming a second layer of tobacco particles over said core layer and over said initial layer at opposite sides of said core layer at a fourth position downstream of said third position, whereby a cigarette filler stream is formed comprising an outer annulus of tobacco surrounding the core material.

46. Apparatus for making a cigarette filler stream, comprising a. support means movable along a predetermined path, b. means forming an initial layer of tobacco particles on said support means at a first position along said path, said initial layer having a predetermined width, c. forming means at a second position along said path downstream of said first position for bending the opposite longitudinal sides of said initial layer towards each other to form a concave surface in said initial layer, d. means for forming a core layer of core material, the said means comprising a conveyor movable along a second path, means for showering said core material on to said conveyor to form a core stream, and transfer means for receiving said core stream and for feeding it on to the concave surface in said initial layer at a third position downstream of said second position, said core layer having a narrower width than said initial layer, and e. means for forming a second layer of tobacco particles over said core layer and over said initial layer at opposite sides of said core layer at a fourth position downstream of said third position, whereby a cigarette filler stream is formed comprising an outer annulus of tobacco surrounding the core material.

47. A method for making a cigarette filler stream, comprising a. forming an initial layer of tobacco particles having a predetermined width on a moving support, b. feeding a pre-formed core stream having a narrower width than said initial layer onto the central portion of said initial layer, and c. forming a second layer of tobacco particles by showering tobacco onto said core stream and onto said initial layer at opposite sides of said core stream, d. to form a cigarette filler stream comprising an outer annulus of tobacco surrounding the preformed core stream.

48. A method for making a cigarette filler stream, comprising a. forming an initial layer of tobacco particles on a moving support, said initial layer having a predetermined width, b. feeding a plurality of pre-formed rods of predetermined length on to said initial layer in succession at spaced intervals, said rods having a narrower width than said initial layer, and c. forming a second layer of tobacco particles by showering tobacco on to said core rods, on to said initial layer at opposite sides of said core layer, and in the spaces between the ends of said rods, d. to form a cigarette filler stream comprising an outer annulus of tobacco surrounding a plurality of spaced rods the ends of which are not visible when said filler stream is severed intermediate the ends of adjacent rods.

49. A method for making a cigarette filler stream, comprising a. forming an initial layer of tobacco particles on a moving support, said initial layer having a predetermined width, b. bending the opposite longitudinal sides of the initial layer towards each other with the aid of centrifugal force while retaining the intermediate longitudinal portion of the initial layer between said opposite sides against the support means to form a concave surface in said initial layer, c. forming a core layer composed of core material on a moving band and then feeding the core layer on to the concave surface of said initial layer, said core layer having a narrower width than said initial layer, d. forming a third layer by showering tobacco particles on to said core layer and on to said initial layer at opposite sides of said core layer.

50. A method of making cigarettes with a filler including a core surrounded by an annulus of tobacco, comprising forming on a conveyor a first layer of tobacco having spaced relatively thick longitudinally extending side portions separated by a relatively thin longitudinally extending middle portion, feeding core material along the middle portion of the first tobacco layer between the relatively thick side portions, and feeding on a second layer of tobacco extending over the core material and over the side portions of the first layer to enclose the core material.

51. A machine for making a cigarette rod having a central portion of core material surrounded by an annulus portion of tobacco, comprising an elongated conveyor, means for showering tobacco onto said conveyor to form a first layer of tobacco on said conveyor, a wall located within said tobacco shower adapted to split the same into substantially equal portions and arranged with an edge portion thereof spaced from, adjacent to and parallel with the longitudinal axis of said conveyor, said edge portion being adapted to penetrate said layer for a predetermined distance along said conveyor to form a longitudinal recess in said layer, means for feeding core material into and along the longitudinal recess in said layer downstream of said wall, means for feeding tobacco onto said core material on said first layer and means for subsequently wrapping the same for forming said cigarette rod.

52. A method of making a continuous cigarette rod containing an annulus of tobacco surrounding a core of different material, comprising forming a first tobacco stream having a predetermined width and a predetermined thickness at least along the middle region of the stream; applying over the said middle region of the first tobacco stream a pre-formed stream of core material having a width less than the said predetermined width of said first tobacco stream, whereby side portions of the first tobacco stream extend laterally beyond the sides of the core stream; applying over the core stream and over the side portions of the first tobacco stream a second tobacco stream having the same predetermined width as the first tobacco stream and having a thickness greater than the said predetermined thickness of said first tobacco stream, at least one of the tobacco streams having side portions which are thicker than the middle region thereof to enclose the sides of the core stream; compressing pneumatically the combined stream comprising the two tobacco streams with the core stream therebetween; trimming away part of the second tobacco stream, while the combined stream is compressed, to position the core stream substantially along the middle of the combined stream; and enclosing the trimmed combined stream in a continuous wrapper to form said continuous cigarette rod.

53. A method according to claim 52 wherein the step of applying a stream of core material comprises applying over the middle region of the first tobacco stream a stream of core material having a thickness substantially the same as the width thereof.

54. A method according to claim 53 wherein the step of applying a stream of core material comprises applying over the middle region of the first tobacco stream a stream of core material having a substantially circular cross-section.

55. A method of making a continuous cigarette rod containing an annulus of tobacco surrounding a core of different material, comprising forming a first tobacco stream having a predetermined width and a predetermined thickness at least along the middle region of the stream; applying over the said middle region of the first tobacco stream a pre-formed stream of core material as a succession of stream sections longitudinally spaced from each other and having a width less than said predetermined width of said first tobacco stream, whereby side portions of the first tobacco stream extend laterally beyond the sides of the core stream; applying over the core stream and over the side portions of the first tobacco stream a second tobacco stream having the same predetermined width as the first tobacco stream and having a thickness greater than said predetermined thickness of said first tobacco stream, at least one of the tobacco streams having side portions which are thicker than the middle region thereof to enclose the sides of the core stream; compressing pneumatically the combined stream comprising the two tobacco streams with the core stream therebetween; trimming away part of the second tobacco stream, while the combined stream is compressed, to position the core stream substantially along the middle of the combined stream; and enclosing the trimmed combined stream in a continuous wrapper to form said continuous cigarette rod.

56. A method of making a continuous cigarette rod containing an annulus of tobacco surrounding a core of different material, comprising forming a first tobacco stream having a predetermined width and a predetermined thickness at least along the middle region of the stream; mechanically compressing a stream of particulate core material to form a pre-formed core stream having a width less than said predetermined width of said first tobacco stream; applying over said middle region of the first tobacco stream said pre-formed core stream, whereby side portions of the first tobacco stream extend laterally beyond the sides of the core stream; applying over the core stream and over the side portions of the first tobacco stream a second tobacco stream having the same predetermined width as the first tobacco stream and having a thickness greater than said predetermined thickness of said first tobacco stream, at least one of the tobacco streams having side portions which are thicker than the middle portion thereof to enclose the sides of the core stream; compressing pneumatically the combined stream comprising the two tobacco streams with the core stream therebetween; trimming away part of the second tobacco stream, while the combined stream is compressed, to position the core stream substantially along the middle of the combined stream; and enclosing the trimmed combined stream in a continuous wrapper to form said continuous cigarette rod.

57. A method of making a continuous cigarette rod containing an annulus of tobacco surrounding a core of different material, comprising forming a first tobacco stream having a predetermined width and a predetermined thickness at least along the middle region of the stream; feeding a stream of core material towards the first tobacco stream in a longitudinally extending concave channel while mechanically, progressively compressing the core stream in the channel to form a preformed core stream having a width less than said predetermined width of said first tobacco stream; applying over said middle region of the first tobacco stream said pre-formed core stream, whereby side portions of the first tobacco stream extend laterally beyond the sides of the core stream; applying over the core stream and over the side portions of the first tobacco stream a second tobacco stream having the same predetermined width as the first tobacco stream and having a thickness greater than said predetermined thickness of said first tobacco stream, at least one of the tobacco streams having side portions which are thicker than the middle region thereof to enclose the sides of the core stream; compressing pneumatically the combined stream comprising the two tobacco streams with the core stream therebetween; trimming away part of the second tobacco stream, while the combined stream is compressed, to position the core stream substantially along the middle of the combined stream; and enclosing the trimmed combined stream in a continuous wrapper to form said continuous cigarette rod.

58. A method of making a continuous cigarette rod containing an annulus of tobacco surrounding a core of different material, comprising forming a first tobacco stream having a predetermined width and a predetermined thickness along the middle region of the stream with side portions which are thicker than the middle region thereof to define a longitudinally extending channel; applying in said longitudinally extending channel of the first tobacco stream a pre-formed stream of core material having a width less than said predetermined width of said first tobacco stream, whereby side portions of the first tobacco stream extend laterally beyond the sides of the core stream; applying over the core stream and over the side portion of the first tobacco stream a second tobacco stream having the same predetermined width as the first tobacco stream and having a thickness greater than said predetermined thickness of said first tobacco stream, at least one of the tobacco streams having side portions which are thicker than the middle region thereof to enclose the sides of the core stream; compressing pneumatically the combined stream comprising the two tobacco streams with the core stream therebetween; trimming away part of the second tobacco stream, while the combined stream is compressed to position the core stream substantially along the middle of the combined stream; and enclosing the trimmed combined stream in a continuous wrapper to form said continuous cigarette rod.

59. A machine for making a continuous cigarette rod having a central portion of core material surrounded by an annulus portion of tobacco, comprising:

a. air-pervious conveyor means;

b. means for applying to said conveyor means a first tobacco stream having a predetermined width and a predetermined thickness at least along the middle region of the stream;

c. means for applying over said middle region of the first tobacco stream a pre-formed stream of core material having a width less than said predetermined width of said tobacco stream such that the side portions of the first tobacco stream extend laterally beyond the sides of the core stream;

d. means for applying over the core stream and over the side portions of the first tobacco stream a second tobacco stream having the same predetermined width as the first tobacco stream and having a thickness greater than said predetermined thickness of said first tobacco stream;

e. at least one of said means for applying said first and second tobacco streams being adapted to provide a tobacco stream having side portions which are thicker than the middle region thereof to enclose the sides of the core stream;

f. pneumatic means for compressing the two tobacco streams with the core stream therebetween;

g. means for trimming away part of the second tobacco stream, while the combined stream is pneumatically compressed, leaving a portion of the second tobacco stream having a thickness substantially equal to the thickness of said first tobacco stream; and h. means for enclosing the trimmed combined stream in a continuous wrapper to form said continuous cigarette rod.

60. A machine according to claim 50 wherein said means for applying said core stream includes means for forming said core stream with a thickness and a width which are substantially the same.

61. A machine according to claim 60 wherein said means for forming said core stream is adapted to form a core stream having a substantially circular cross-section.

62. A machine for making a continuous cigarette rod having a central portion of core material surrounded by an annulus portion of tobacco, comprising:

a. air-pervious conveyor means;

b. means for applying to said conveyor means a first tobacco stream having a predetermined width and a predetermined thickness at least along the middle region of the stream;

c. means for forming a succession of longitudinally spaced core stream sections, each formed of core material and having a width less than said predetermined width of said first tobacco stream;

d. means for applying over said middle region of the first tobacco stream said succession of longitudinally spaced stream sections such that the side portions of the first tobacco stream extending laterally beyond the sides of the spaced core stream sections;

e. means for applying over the core stream sections and over the side portions of the first tobacco stream a second tobacco stream having the same thickness greater than said predetermined thickness of said first tobacco stream;

f. at least one of said means for applying said first and second tobacco streams being adapted to provide a tobacco stream having side portions which are thicker than the middle region thereof to enclose the sides of the core stream sections;

g. pneumatic means for compressing the two tobacco streams with the core stream sections therebetween;

h. means for trimming away part of the second tobacco stream, while the combined stream is pneumatically compressed, leaving a portion of the second tobacco stream having a thickness substantially equal to the thickness of said first tobacco stream; and i. means for enclosing the trimmed combined stream in a continuous wrapper to form said continuous cigarette rod.

63. A machine for making a continuous cigarette rod having a central portion of core material surrounded by an annulus portion of tobacco, comprising;

a. air-pervious conveyor means;

b. means for applying to said conveyor means a first tobacco stream having a predetermined width and a predetermined thickness at least along the middle region of the stream;

c. means for forming particulate core material into a core stream and means for mechanically compressing the core stream into a pre-formed core stream having a width less than said predetermined width of said first tobacco stream;

d. means for applying over the middle region of the middle region of the first tobacco stream said preformed core stream such that the side portions of the first tobacco stream extend laterally beyond the sides of the pre-formed core stream;

e. means for applying over the core stream and over the side portions of the first tobacco stream a second tobacco stream having the same predetermined width as the first tobacco stream and having a thickness greater than said predetermined thickness of said first tobacco stream;

f. at least one of said means for applying said first and second tobacco streams being adapted to provide a tobacco stream having side portions which are thicker than the middle region to enclose the sides of the core stream;

g. means for compressing the two tobacco streams with the core stream therebetween;

h. means for trimming away part of the second tobacco stream, while the combined stream is pneumatically compressed, leaving a portion of the second tobacco stream having a thickness substantially equal to the thickness of said first tobacco stream; and i. means for enclosing the trimmed combined stream in a continuous wrapper to form said continuous cigarette rod.

64. A machine for making a continuous cigarette rod having a central portion of core material surrounded by an annulus portion of tobacco, comprising:

a. air-pervious conveyor means;

b. means for applying to said conveyor means a first tobacco stream having a predetermined width and a predetermined thickness at least along the middle region of the stream;

c. means for forming a pre-formed core stream with a predetermined cross-sectional area and having a width less than said predetermined width of said first tobacco stream;

d. means for applying over said middle region of the first tobacco stream said pre-formed core stream such that the side portions of the first tobacco stream extend laterally beyond the sides of the core stream;

e. means for applying over the core stream and over the side portions of the first tobacco stream a second tobacco stream having the same predetermined width as the first tobacco stream and having a thickness greater than said predetermined thickness of said first tobacco stream;

f. at least one of said means for applying said first and second tobacco streams being adapted to provide a tobacco stream having side portions which are thicker than the middle region thereof to enclose the sides of the core stream;

g. pneumatic means for compressing the two tobacco streams with the core stream therebetween;

h. means for trimming away part of the second tobacco stream, while the combined stream is pneumatically compressed leaving a portion of the second tobacco stream having a thickness substantially equal to the thickness of said first tobacco stream; and i. means for enclosing the trimmed combined stream in a continuous wrapper to form said continuous cigarette rod;

j. said means for applying said second tobacco stream, said pneumatic compressing means, said trimming means and said means for enclosing the combined stream in a continuous wrapper being adapted to retain said predetermined cross-sectional area of said core stream.

65. A machine for making a continuous cigarette rod having a central portion of core material surrounded by an annulus portion of tobacco, comprising:

a. air-pervious conveyor means;

b. means for applying to said conveyor means a first tobacco stream having a predetermined width and a predetermined thickness at least along the middle region of the stream;

c. means for applying over said middle region of the first tobacco stream a pre-formed stream of core material having a width less than said predetermined width of said first tobacco stream such that the side portions of the first tobacco stream extending laterally beyond the sides of the core stream;

d. said means for applying said core stream including a concave endless band for feeding the stream of core material towards the first tobacco stream and a fixed tongue converging towards the band in the direction of movement of the band in the direction of movement of the band for mechanically compressing the core stream between the band and the tongue;

e. means for applying over the core stream and over the side portions of the first tobacco stream a second tobacco stream having the same predetermined width as the first tobacco stream and having a thickness greater than said predetermined thickness of said first tobacco stream;

f. at least one of said means for applying said first and second tobacco streams being adapted to provide a tobacco stream having side portions which are thicker than the middle region thereof to enclose the sides of the core stream;

g. pneumatic means for compressing the two tobacco streams with the core stream therebetween;

h. means for trimming away part of the second tobacco stream, while the combined stream is pneumatically compressed, leaving a portion of the second tobacco stream having a thickness substantially equal to the thickness of said first tobacco stream; and i. means for enclosing the trimmed combined stream in a continuous wrapper to form said continuous cigarette rod.

66. A machine for making a continuous cigarette rod having a central portion of core material surrounded by an annulus portion of tobacco, comprising:

a. air-pervious conveyor means;

b. means for forming and applying to said conveyor means a first tobacco stream having a predetermined width, a predetermined thickness at least along the middle region of the stream and side portions which are thicker than the middle region thereof to define a longitudinally extending channel;

c. means for applying in said longitudinally extending channel of the first tobacco stream a pre-formed stream of core material having a width less than said predetermined width of said first tobacco stream such that the side portions of the first tobacco stream extend laterally beyond the sides of the core stream;

d. means for applying over the core stream and over the side portions of the first tobacco stream a second tobacco stream having the same predetermined width as the first tobacco stream and having a thickness greater than said predetermined thickness of said first tobacco stream;

e. pneumatic means for compressing the two tobacco streams with the core stream therebetween;

f. means for trimming away part of the second tobacco stream, while the combined stream is pneumatically compressed, leaving a portion of the second tobacco stream having a thickness substantially equal to the thickness of said first tobacco stream; and g. means for enclosing the trimmed combined stream in a continuous wrapper to form said continuous cigarette rod.

67. Apparatus for making a cigarette filler stream, comprising a. support means movable along a predetermined path, b. first means for forming an initial layer of tobacco particles on said support means at a first position along said path, said initial layer having a predetermined width, c. second means for feeding a succession of core layer sections of predetermined length onto said initial layer with spaces between the ends of adjacent core layer sections at a second position along said path downstream of said first position, said core layer sections having a narrower width than said initial layer and having side edges laterally spaced inwards from the side edges of said initial layer, and d. third means arranged to apply a third layer of tobacco particles into said spaces between the ends of adjacent core layer sections, on said core layer sections and on said initial layer at opposite sides of said core layer sections at a third position downstream of said second position, e. whereby a cigarette filler stream is formed comprising an outer annulus of tobacco particles surrounding a succession of core layer sections.

68. A machine for making a continuous cigarette rod having a central portion of particulate core material surrounded by an annulus portion of tobacco, said machine including a conveyor, means for forming a layer of tobacco having a predetermined width on said conveyor, means for forming a layer of said particulate core material having a width narrower than the width of said tobacco layer along the middle portion of the surface of said layer of tobacco such that the side edges of said core material layer are laterally spaced inwards from the side edges of said tobacco layer, and means for subsequently forming a layer of further tobacco on the surfaces of the core material layer and tobacco layer at opposite sides of said core material layer to surround the core material with tobacco.

69. A machine for making a continuous cigarette rod having a filler including two different particulate materials, comprising conveyor means arranged for movement along a path; means for forming a continuous stream of a first particulate material on said conveyor means; means for retaining a succession of spaced sections of said first material stream at regular intervals on said conveyor means; means for ejecting spaced portions of said first material stream between said spaced sections from said conveyor means; means for forming a continuous layer of a second particulate material over said spaced sections of said first material stream and in the spaces between successive sections; means for trimming said layer of second material to form a cigarette filler stream; and means for enclosing said filler stream in a wrapper to form a continuous cigarette rod which is adapted to be cut at regular intervals at positions between the ends of successive sections of said first material.

70. A rod making machine according to claim 69 in which said means for ejecting portions of said stream of said first material comprises pneumatic means.

71. A cigarette rod making machine according to claim 70 in which said pneumatic means comprises a member adjacent to said conveyor means and adapted to move at the same speed as said conveyor means, said member including at least one port for directing an air stream to eject said portions of said first material stream.

72. A cigarette rod making machine according to claim 69 in which said conveyor means comprises an air-permeable conveyor band and said ejecting means comprises a pulley about which said conveyor band is arranged to pass, said pulley including said retaining means which is adapted to apply suction through said band at predetermined circumferentially spaced areas around the periphery of the pulley to retain on the band said sections of said stream of first material adjacent to those areas while said intermediate portions of said stream are ejected.

73. A cigarette rod making machine according to claim 72 in which said means for ejecting said portions of said stream of first material further comprises a suction wheel having at least one port in the periphery thereof adjacent to said pulley and means for applying suction as timed pulses through said port to eject said portions.

74. A cigarette rod making machine according to claim 72 in which said means for ejecting said portions of said stream of first material further comprises means within said pulley for directing an air stream against said intermediate portions of the said stream of said first material.

75. A cigarette rod making machine according to claim 69 wherein said means for forming said continuous stream of said first particulate material is adapted to form said stream with a predetermined width and said means for forming said continuous layer of said second particulate material is adapted to form said layer with a width wider than said predetermined width; said machine further comprising second conveyor means and means for forming on said second conveyor means an initial layer of said second material having a width greater than said predetermined width, said first mentioned conveyor means being arranged to feed said successive sections of said first material centrally along said initial layer before said means for forming a layer of said second material applies said layer over said sections of said first material stream and in the spaces between said successive sections, whereby said spaced sections of said first material stream are enclosed in said second material in the completed cigarette filler stream.

76. A cigarette rod making machine according to claim 75 further comprising means for forming said initial layer into a U-shaped cross-section to receive said spaced successive sections of said first material.

77. A cigarette rod making machine according to claim 76 further comprising a tongue spaced from said first mentioned conveyor means for compressing said spaced sections of said first material before being applied to said initial layer.

78. A cigarette rod making machine according to claim 77 further comprising a compression wheel upstream of said tongue for reducing the cross-sectional area of said successive sections of said first material.

79. A cigarette rod making machine according to claim 78 in which said compression wheel includes lobes for entering said spaces between said successive sections of said first material to maintain said spaces between said successive sections.

80. A cigarette rod making machine according to claim 69 further comprising means for trimming said continuous stream of said first material before said portions of said first material stream are ejected by said ejecting means.

81. A cigarette rod making machine according to claim 69 wherein said means for forming said layer of said second material over said sections of said first material stream and spaces between said successive sections comprises means for showering particles of said second material.

82. A machine for making a continuous rod comprising conveyor means arranged for movement along a path, means for forming onto said conveyor means a continuous initial layer of a first material having a hollow channel therein, means for intermittently feeding a second material into said channel at regularly spaced locations as said initial layer is conveyed along said path, and means for continuously enclosing said continuous initial layer and second material at spaced locations in a wrapper to form a continuous rod which is adapted to be cut at regular intervals at positions between said spaced locations.

83. A machine for making a continuous rod according to claim 82 wherein said forming means comprises means for feeding said first material onto said conveyor means and means for shaping said first material into a U-shaped cross-section to provide said hollow channel.

84. A machine for making a continuous rod according to claim 83 wherein said feeding means is adapted to feed a predetermined amount of a particulate second material into said channel in said first layer.

* * * * *